US006849102B2

(12) United States Patent
Murty et al.

(10) Patent No.: US 6,849,102 B2
(45) Date of Patent: Feb. 1, 2005

(54) METAL MATRIX COMPOSITES WITH INTERMETALLIC REINFORCEMENTS

(75) Inventors: Gollapudi S. Murty, Wheeling, WV (US); Brian E. Joseph, Wheeling, WV (US)

(73) Assignee: Touchstone Research Laboratory, Ltd., Triadelphia, WV (US)

( * ) Notice: Subject to any disclaimer, the term of this patent is extended or adjusted under 35 U.S.C. 154(b) by 0 days.

(21) Appl. No.: 10/460,312

(22) Filed: Jun. 13, 2003

(65) Prior Publication Data

US 2003/0230168 A1 Dec. 18, 2003

Related U.S. Application Data

(60) Provisional application No. 60/387,894, filed on Jun. 13, 2002.

(51) Int. Cl.[7] ..... C22C 1/04; B22F 3/12

(52) U.S. Cl. ..... 75/245; 75/249; 419/48; 419/49

(58) Field of Search ..... 75/245, 249, 338, 75/355, 255; 419/48, 49, 50

(56) References Cited

U.S. PATENT DOCUMENTS 4,347,076 A * 8/1982 Ray et al. ..... 75/255
4,435,213 A 3/1984 Hildeman et al.
4,687,511 A * 8/1987 Paliwal et al. ..... 75/252
4,737,339 A * 4/1988 Couper ..... 419/23
4,836,982 A 6/1989 Brupbacher et al.
5,049,211 A 9/1991 Jones et al.
5,368,657 A * 11/1994 Anderson et al. ..... 148/400
5,532,069 A * 7/1996 Masumoto et al. ..... 428/552
5,614,150 A 3/1997 Bowden
5,851,317 A 12/1998 Biner et al.
5,858,132 A * 1/1999 Bell et al. ..... 148/441

OTHER PUBLICATIONS

"Tensile Strength and Fracture Toughness of Particulate SiC–2124", High Performance Composites: Commonality of Phenomena, Edited by K.K. Chawla, P.K. Liaw and S.G. Fishman, *The Minerals, Metals & Materials Society*, 1994, pp. 347–359.

"Effect of Heat Treatment on the Microstructure and Mechanical Properties of Rapidly Solidified 7091 P/M Aluminium Alloy", © Carl Hanser Verlag, München, *Prakt. Metallogr.* 30 (1993) 4, pp. 186–199.

"Elevated Temperature Deformation Response of Powder Processed Aluminum Alloys with Intermetallic Dispersons", G.S. Murty, Department of Metallurgical Engineering, Indian Institute of Technology, Kanpur 208 016, India, *Solid State Phenomena* vols. 8 & 9 (1989), pp. 269–280.

"Superplastic Characteristics of Modified 7075 AI and AI—Ti Alloys Processed by Rapid Solidification Powder Metallurgy", G.S. Murty and M.J. Koczak, Department of Materials Engineering, Drexel University, Philadelphia, PA 19102, in "Processing and Properties for Powder Metallurgy Composites" eds. P. Kumar, K. Vedula and A. Ritter (TMS/AIME Symposium 1987), p. 139–154.

* cited by examiner

*Primary Examiner*—Ngoclan T. Mai
(74) *Attorney, Agent, or Firm*—McGuireWoods LLP

(57) ABSTRACT

A discontinuously reinforced metal composite, having a metal matrix and a plurality of intermetallic particles comprising at least two different metals, the intermetallic particles having a size ranging from 1 $\mu$m to about 10 $\mu$m and being dispersed within the metal matrix in an amount of at least 20% by volume, wherein the intermetallic particles are particles having at least one same metal as the metal in the metal matrix.

19 Claims, 2 Drawing Sheets

METAL MATRIX COMPOSITES WITH INTERMETALLIC REINFORCEMENTS

CROSS-REFERENCE TO RELATED APPLICATIONS

This application is based on and claims priority to U.S. Provisional Patent Application No. 60/387,894, filed Jun. 13, 2002, herein incorporated by reference in its entirety.

BACKGROUND OF THE INVENTION

Generally, composite materials constitute a class of materials that provide for design flexibility by allowing their properties to be tailored according to the specific requirements for different applications. For example, metal matrix composites, such as aluminum matrix composites may be used for a variety of structural and non-structural applications, including applications for electronics, automotive and aerospace industries. Composite materials are generally classified on the basis of the shape and size of the reinforcements.

One type of composite material contains continuous fibers running along the length of the matrix. FIG. 2 shows a continuous fiber composite (10) made of a metal matrix (20) which is reinforced with ceramic fiber (30). FIG. 3 shows another type of composite material that has discontinuous ceramic fiber reinforcements. In the metal matrix composite (100) shown in FIG. 1, the particulate reinforcements (300) are intermetallics.

The properties of the composite materials are influenced by the matrix material as well as by the type, shape, size, and volume fraction of the reinforcing material. The main strengthening mechanism of continuous fiber composites is based on load transfer from the matrix to the fibers and the load is mainly carried by the fibers. The highest levels of strength and stiffness are attained using continuous fibers aligned in the direction of loading as the strong fibers carry the majority of the load. Although continuous fiber composites have superior strength in the direction of the fibers, their applications are limited by their high costs of production, the problems associated with their processing and their inferior transverse properties.

Generally, discontinuously reinforced composites are weaker than continuous fiber composites. However, discontinuously reinforced matrix composites are attractive for reasons such as their low cost, increased flexibility in processing and isotropy of mechanical properties.

For example, silicon carbide (SiC) is commonly used to manufacture discontinuously reinforced metal matrix composite materials. In particular, particulate composites of aluminum matrices with silicon carbide as the reinforcing material are commonly used. However, the load sharing by the silicon carbide particles is limited by the inherently weaker bond of the metal/ceramic systems.

There is need for a discontinuously reinforced metal matrix composite that has improved strength, stiffness and toughness and provides greater flexibility in processing. There is also a need for a processing method which allows for better processing control.

SUMMARY OF THE INVENTION

This invention provides a discontinuously reinforced metal matrix composite, comprising a metal matrix and a plurality of intermetallic particles comprising at least two different metals, the intermetallic particles having a size ranging from 1 $\mu$m to about 10 $\mu$m and being dispersed within the metal matrix in an amount of at least 20% by volume, wherein the intermetallic particles are particles having at least one same metal as the metal in the metal matrix.

This invention separately provides a method for processing metal matrix composites, comprising atomizing a molten alloy of at least two different metals to form a metal matrix to produce powder particles containing a metal matrix and intermetallic particles, wherein the intermetallic particles are dispersed in the metal matrix in an amount of at least 20% by volume.

This invention separately provides a method for processing metal matrix composites, comprising atomizing a molten alloy of at least two different metals to form a metal matrix to produce powder particles containing a metal matrix and intermetallic particles with a size ranging from 1 $\mu$m to about 10 $\mu$m.

BRIEF DESCRIPTION OF THE INVENTION

These and other features and advantages of this invention are described in the following detailed description of various exemplary embodiments of this invention.

DETAILED DESCRIPTION OF THE INVENTION

Figure 1:
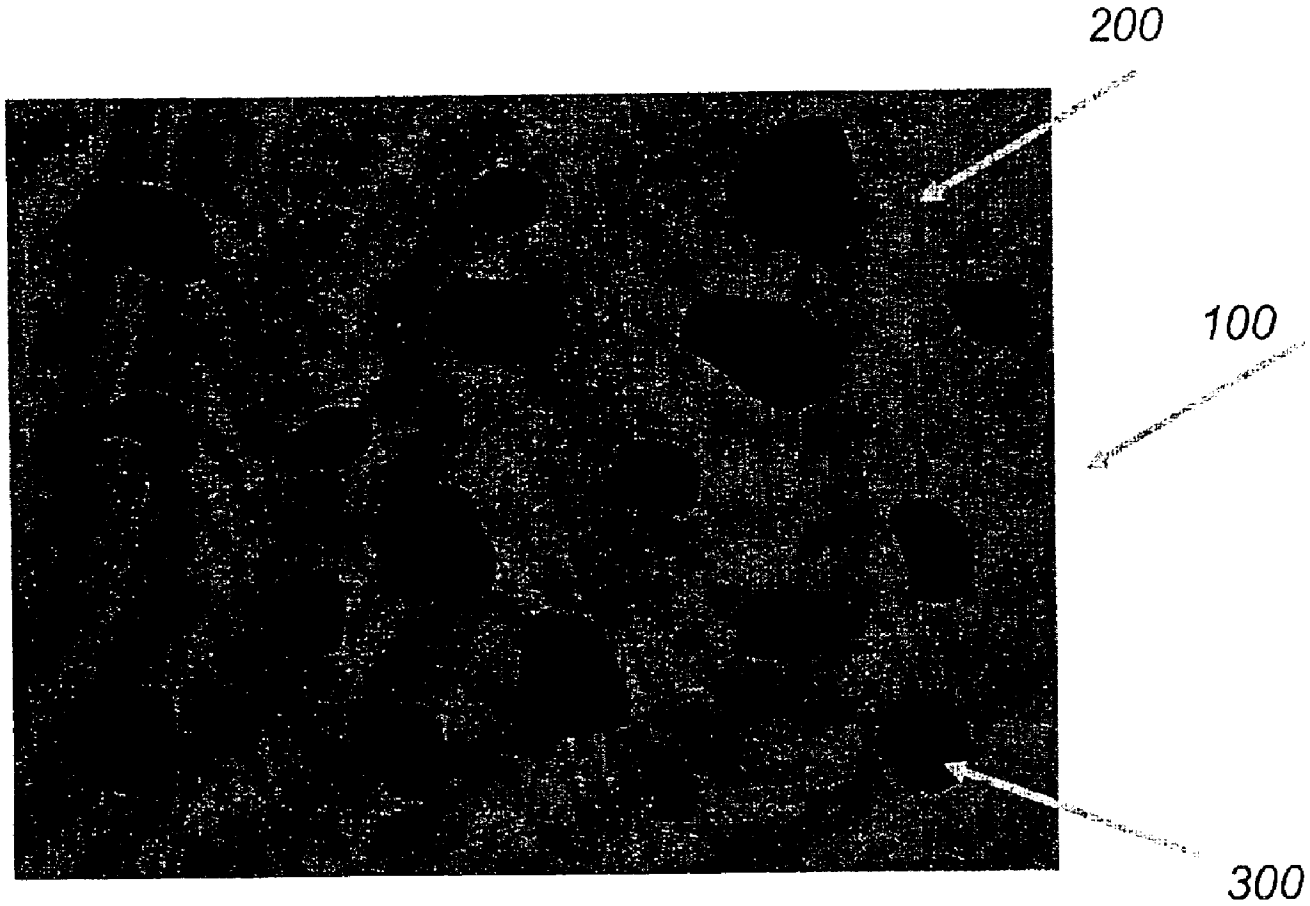
FIG. 1 is a schematic of a discontinuous metal matrix composite in accordance with one embodiment of the present invention.
Figure 2:
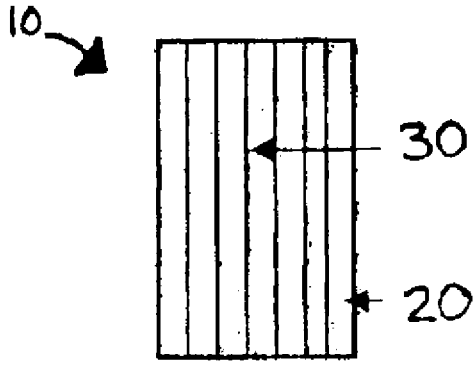
FIG. 2 is a schematic of a continuous fiber metal matrix composite.
Figure 3:
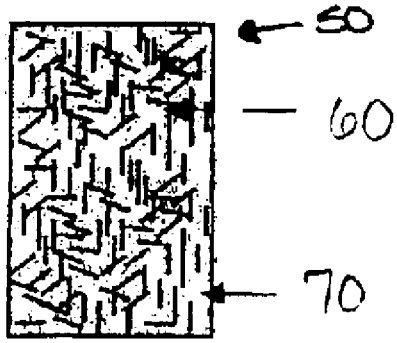
FIG. 3 is a schematic of a discontinuous and randomly oriented ceramic/metal fiber composite.

This invention provides a discontinuously reinforced metal composite having intermetallic particles with at least two different metals dispersed within a metal matrix. The interfacial properties of metal/intermetallics are superior to those of metal/ceramic particles. Further, the intermetallic particles allow for greater flexibility in their processing as compared to metal matrix composites with non-metallic particles (i.e., ceramic particles) as the reinforcing material.

This invention separately provides processing of particulate composites of metals with intermetallic reinforcements through rapid solidification and powder metallurgy (P/M) techniques. Rapid solidification processing can be adopted when using intermetallic particles. Also, when using intermetallic particles, liquid alloys of desired compositions are gas atomized to produce pre-alloyed powders. This processing method allows for better control over the size range and distribution of the reinforcing particles and thereby, provides discontinuously reinforced metal matrix composites with improved properties.

The reinforcing effects of particulates in metals include various strengthening mechanisms. For example, the particulates exert constraints on the plastic deformation of the matrix. Although load sharing by the particles occurs in a discontinuously reinforced matrix, the particles share a smaller amount of the load than fibers do. Matrix strengthening is a part of the overall strength of discontinuously reinforced metal matrix composites.

Various factors that influence the mechanical behavior of the particulate composites include the nature and type of the particulate phase (strength and deformability), particle size, volume fraction, shape of particles (aspect ratio), coefficient of thermal expansion (CTE) between the matrix and the particulate phase, bond strength between the matrix and the particulate material, and matrix characteristics.

Generally, particulate composites encompass a very wide range of particulate sizes. One category of particulate composites is the dispersion strengthened metals consisting of submicron sized and hard particles that directly inhibit dislocation motion in the matrix through the Orowan mechanism. Generally, the required fraction of particulate phase in dispersion strengthened materials is relatively small. Such dispersion strengthened materials may be used, for example, for elevated temperature applications. However, such dispersion strengthened materials undergo more extensive and expensive processing.

A second type of particulate composites involves particulates of micron size where stiffness and strength enhancements occur and these composites can be used for structural applications. A third type of particulate composites has coarser particulates with sizes in the range of about 50 to 250 $\mu$m. This type of particulate composites provides greater flexibility and ease of processing and they are useful for applications susceptible to wear.

The strengthening mechanism of these composites, in general involves several components, such as, matrix strengthening, thermal residual stresses through coefficient of thermal expansion (CTE) mismatch, and load transfer from the matrix to the particles. The aspect ratio of the particles is an important factor that influences the load transfer from the matrix to the particles. The extent of strengthening in these particulate composites increases as the particle size decreases and also with the increase in the amount of particulate phase.

For structural applications, the properties of interest are strength, stiffness and fracture toughness. Usually, for structural applications, fine particles (particles with a diameter of 20 $\mu$m or less and preferably, less than about 10 $\mu$m) and a high volume fraction of particles (greater than or equal to about 20% by volume) are used.

Development of metal matrix particulate composites for structural applications involves enhancing their mechanical properties while increasing their processing flexibility. The load sharing component of the particulate phase should be improved in order to increase the overall strength and stiffness of the metal matrix composite. An important property with regard to the load sharing feature is the interfacial shear strength between the matrix and the reinforcing intermetallic phase because the load transfer-ability and the strengthening effect of reinforcement will increase with bond strength between the intermetallic phase and the matrix.

A higher bond strength may also be of interest from the viewpoint of the fracture toughness of the discontinuously reinforced metal matrix composite. As compared to a metal matrix strengthened through alloying and heat treatment, a metal matrix strengthened with intermetallics is more capable of retaining its strength at elevated temperatures, and thus, can be used under higher operating temperatures. A Fiber Push-Out Scanning Electron Microscope may be used to measure the bond strength and sliding friction between fibers and their matrices.

In one embodiment of this invention the discontinuously reinforced metal composite includes a metal matrix and intermetallic particles having at least two different metals dispersed within the metal matrix. In various embodiments of this invention, the metal used for the metal matrix is not particularly limited and may include, for example, aluminum, magnesium, titanium, niobium and other processable metals and alloys thereof that form intermetallic compounds on alloying suitably. As discussed above, the interfaces between metals and intermetallics are generally stronger than those between metals and ceramics.

In various embodiments of this invention, at least one metal in the intermetallic particle is the same as the matrix metal. The combination of metals used for the intermetallic particles is not particularly limited and may include, for example, aluminum, titanium, niobium, magnesium, iron, chromium, vanadium, zirconium and other metals that form intermetallics with the matrix metal.

In forming the discontinuously reinforced metal composite of the present invention the intermetallic particles are dispersed within the metal matrix. As discussed above, for structural applications, the particle size of the intermetallic particles should be below 20 $\mu$m, and more preferably below about 10 $\mu$m.

In the various embodiments of this invention, the intermetallic particles should be added to the metal matrix in an amount necessary to increase the strength and stiffness of the metal matrix composite relative to those of the metal matrix alone. In the various embodiments of this invention, the intermetallic particles are added in an amount ranging from about 10% to about 70% by volume.

FIG. 1 shows a discontinuously reinforced metal matrix composite 100 in accordance with an exemplary embodiment of the present invention. The discontinuous reinforced metal matrix composite 100 includes intermetallic particles 300 dispersed within a metal matrix 200.

The selection of the intermetallic particles may involve a variety of considerations. In various embodiments of the invention, the intermetallic particles are intermetallic particles which have a low density, high elastic modulus and strength, and good thermal stability. One such material is, for example, tri-aluminide of iron ($FeAl_3$).

Discontinuously reinforced metal matrix composites according to this invention may be processed through rapid solidification and powder metallurgy routes. The alloys of desired composition may be inert gas atomized to produce pre-alloyed powders. The cooling rate of the powder particle depends on the powder particle size. The smaller the powder particle size, the greater is the cooling rate. The intermetallic particle size varies with the cooling rate. Finer and/or coarser powder sizes may be used for further processing to vary the particulate size.

Selection of pre-alloyed powder size is the basis for varying the particulate size. In various embodiments of this invention, the size of the particulate phase is about 20 $\mu$m or less (preferably about 10 $\mu$m or less) in the composite.

The pre-alloyed powders produced by inert gas atomization may be consolidated through powder metallurgy routes of processing which include vacuum hot pressing followed by hot extrusion to obtain bars of round or rectangular cross-section.

The following is a description of the method for processing of the composites through powder metallurgy (P/M) route. In general, the P/M route includes the following steps: (1) producing atomized powder of the matrix alloy; (2) blending of the matrix alloy powder and reinforcement in powder form; (3) canning and degassing of the blended powders; (4) vacuum hot pressing to produce billets; and (5) hot extrusion into bars.

The following is an exemplary example of processing through the P/M route. In this example, aluminum is used as the metal matrix and $FeAl_3$ is used as the intermetallic particle. However, as discussed above, various metals and intermetallic particles may be used.

First, Al—Fe alloy composition is selected from phase diagrams to yield a given volume fraction of $FeAl_3$. Then, a liquid alloy of the desired composition is inert gas atomized to produce powder particles containing aluminum matrix and $FeAl_3$ particles which are formed during rapid solidification of the melt. Next, the powder particles are sieved to obtain particles in the desired size range. Then, the powder is canned, degassed and vacuum hot pressed to produce billets before the bars are formed via hot extrusion. In particular, to can the powder, for example, the powder particles, the powder particles may be initially subjected to cold compaction during which the powder is canned at about room temperature or slightly higher and then subjected to hard compaction during which the canned powder is pressure packed into a container and heated.

It should be obvious to one of ordinary skill in the art that the discontinuous reinforced metal matrix composites of the present invention may be used in the variety of structures requiring greater strength and stiffness than the metal alone. The materials of the present invention may be used for vehicle parts, structural materials, and the like.

It should be obvious to one of ordinary skill in the art at the time of the invention that this invention provides a metal matrix having intermetallic particles formed of at least two metals dispersed therein. By providing a metal matrix with intermetallic particles dispersed therein, the resulting composites have a better interfacial bond strength than metal/ceramic composites. In addition, this invention allows for good control on the size range and distribution of the intermetallic particles through rapid solidification and powder metallurgy (P/M) route of processing. The resulting intermetallic/metal matrix composites according to this invention have improved properties as compared to metal/ceramic particulate composites for a given particulate size and volume fraction of reinforcing particles.

What is claimed is:

1. A discontinuously reinforced metal composite, comprising:

a metal matrix; and a plurality of intermetallic particles having a size ranging from 1 $\mu$m to about 20 $\mu$m dispersed within the metal matrix in an amount of at least 20% by volume, wherein the intermetallic particles consist essentially of a first metal that is the same as the metal in the metal matrix, and a second metal that is different than the first metal.

2. The discontinuously reinforced metal composite of claim 1, wherein the metal matrix comprises aluminum and wherein the first metal comprises aluminum.

3. The discontinuously reinforced metal composite of claim 1, wherein the plurality of intermetallic particles are $FeAl_3$.

4. The discontinuously reinforced metal composite of claim 1, wherein the intermetallic particles are dispersed within the metal matrix in an amount ranging from at least 20% by volume to about 50% by volume.

5. The discontinuously reinforced metal composite of claim 1, wherein the metal matrix is selected from the group consisting of aluminum, titanium, niobium, and magnesium, or an alloy thereof.

6. The discontinuously reinforced metal composite of claim 1, wherein the second metal is selected from the group consisting of aluminum, titanium, niobium, magnesium, iron, chromium, vanadium and zirconium.

7. A method for processing metal matrix composites, comprising atomizing a molten alloy of at least two different metals to form a metal matrix to produce powder particles containing a metal matrix and intermetallic particles, wherein the intermetallic particles are dispersed in the metal matrix in an amount of at least 20% by volume.

8. The method of processing of claim 7, wherein the intermetallic particles are dispersed in the metal matrix in an amount ranging from about 20% by volume to about 70% by volume.

9. The method of processing of claim 7, wherein the intermetallic particles are dispersed in the metal matrix in an amount ranging from about 30% by volume to about 70% by volume.

10. The method of processing of claim 7, wherein a size of the intermetallic particles are below about 20 $\mu$m.

11. The method of processing of claim 7, further comprising post processing of the powder particles by hot pressing and extrusion.

12. The method of processing of claim 7, further comprising post processing of the powder particles by hot pressing and rolling.

13. The method of processing of claim 7, further comprising post processing of the powder particles by hot isostatic pressing.

14. A method for processing metal matrix composites, comprising atomizing a molten alloy of at least two different metals to form a metal matrix to produce powder particles containing a metal matrix and intermetallic particles with a size ranging from 1 $\mu$m to about 20 $\mu$m.

15. The method of processing of claim 14, wherein the size of intermetallic particles ranges from about 1 $\mu$m to about 10 $\mu$m.

16. The method of processing of claim 14, further comprising post processing of the powder particles by hot pressing and extrusion.

17. The method of processing of claim 14, further comprising post processing of the powder particles by hot pressing and rolling.

18. The method of processing of claim 14, further comprising post processing of the powder particles by hot isostatic pressing.

19. The discontinuously reinforced metal composite of claim 1, wherein the size of the intermetallic particles range from about 1 $\mu$m to about 10 $\mu$m.

* * * * *